US008597165B1

(12) United States Patent
Antonucci

(10) Patent No.: US 8,597,165 B1
(45) Date of Patent: Dec. 3, 2013

(54) EXERCISE TRAINING DEVICE

(76) Inventor: Jonathan Antonucci, Mansfield, MA (US)

( * ) Notice: Subject to any disclaimer, the term of this patent is extended or adjusted under 35 U.S.C. 154(b) by 278 days.

(21) Appl. No.: 13/134,275

(22) Filed: Jun. 3, 2011

(51) Int. Cl.
*A63B 21/00* (2006.01)

(52) U.S. Cl.
USPC ..... 482/131; 482/130

(58) Field of Classification Search
USPC ..... 482/131, 148, 79, 80, 92–100, 101, 482/104, 111–113, 135–137, 139, 142, 145, 482/130; D21/662, 673, 675–676, 685, D21/686, 690–693
See application file for complete search history.

(56) References Cited

U.S. PATENT DOCUMENTS

| | | | | | |
|---|---|---|---|---|---|
| 4,535,985 | A | | 8/1985 | Mask | |
| 4,709,923 | A | | 12/1987 | Gibson | |
| 4,888,875 | A | | 12/1989 | Strother | |
| 5,014,980 | A | * | 5/1991 | Bersonnet et al. | 482/62 |
| 5,108,095 | A | | 4/1992 | Nichols | |
| 5,263,913 | A | | 11/1993 | Boren | |
| 5,433,685 | A | | 7/1995 | Winslow et al. | |
| 5,527,248 | A | * | 6/1996 | Crivello | 482/96 |
| 5,549,532 | A | | 8/1996 | Kropp | |
| 5,588,841 | A | | 12/1996 | Mechling | |
| 6,761,672 | B1 | | 7/2004 | Williams | |
| 7,090,629 | B1 | | 8/2006 | Abbou | |
| 7,608,025 | B1 | * | 10/2009 | Best | 482/123 |
| 8,025,615 | B1 | * | 9/2011 | Sargent | 482/139 |
| 8,075,456 | B2 | * | 12/2011 | Fugitt | 482/92 |
| 2002/0198090 | A1 | * | 12/2002 | McKinney | 482/148 |
| 2004/0097353 | A1 | * | 5/2004 | Mencis et al. | 482/148 |
| 2006/0247097 | A1 | * | 11/2006 | La Voie et al. | 482/8 |
| 2008/0199839 | A1 | | 8/2008 | Fugitt | |
| 2010/0048368 | A1 | * | 2/2010 | Donofrio | 482/130 |

* cited by examiner

*Primary Examiner* — Loan Thanh
*Assistant Examiner* — Nyca T Nguyen
(74) *Attorney, Agent, or Firm* — D. Michael Burns

(57) ABSTRACT

A training device to induce the proper technique required to perform squatting exercises. The device is designed to be portable and constructed from light weight, cylindrical aluminum tubes, and includes foot guides, and knee guides, and hand grip, all of which may be moved to comply with the user's body size and degree of comfort. The foot guides are mounted to a foot rod that is secured in place by a pair of support legs, and the foot guides have a lateral range of movement of 3 to 20 inches. The knee guides slide laterally over a knee pole and have a range of movement from 3 to 20 inches. An adjustment rod provides for the knee guides to be varied from a height of 10 inches to a height of 21 inches. The hand grip may be placed at a distance from 44 to 54 inches and be capable of movement of 2 to 6 inches horizontally.

18 Claims, 3 Drawing Sheets

EXERCISE TRAINING DEVICE

FIELD OF THE INVENTION

The present invention relates to a training device, specifically, to a device that induces the proper technique required to perform squatting exercises.

BACKGROUND OF THE INVENTION

This invention is a physical exercise training device and more particularly to a self-contained, hand-transportable device for use in rehabilitation clinics, personal home settings, and public and personal training facilities.

The squat is a well-known exercise for the muscles of the thighs, knees, hips and buttocks, as well as strengthening the bones, ligaments and insertion of the tendons throughout the lower body, and is commonly used in rehab programs. The advantage of the squat is that it is a closed-chain exercise where ankle, knee and hip joints must be coordinated, developing a functional movement pattern as well as training the muscles. All the knee muscles—quadriceps, hamstrings and gastrocnemius—are involved in the squat to a greater or lesser extent.

The squat can be performed in a variety of ways. It may involve the use of barbells or be performed without any resistance weights, but elements such as proper knee angle with the degree of knee flexion, foot position with wide or narrow stance, are always important.

Proper squatting technique is crucial because if not performed correctly the squat can cause a great deal of stress and strain on the knees. When performing the squat exercise people tend to have their knees knock inward, which puts stress on the MCL and predisposes them to MCL injuries. Also, when training, people tend to shift their weight forward and allowing their knees to move forward past their toes. This improper technique produces shear force on the ACL and will over develop the quadriceps muscles.

During rehabilitation and learning how to train, the clinician or personal trainer needs to spend time over and over again teaching and re-teaching squat technique. A need exists for a device that will insure that extra time is not wasted during the teaching and re-teaching phase, allowing the clinician to work more efficiently. The clinician/trainer needs to be reassured that when their subject is performing squats, under their supervision or not, their technique is flawless. As the individual progresses through their lower body exercise programs, the gap between body weight and weight resisted squats should be bridged. Many lower body exercise equipment are large and bulky and do not monitor safe technique. A need exists for a device that is light weight, easy to setup, take down, store, transport and use.

Accordingly, it is an object of the present invention to provide a self-contained, hand-transportable exercise training device kit readily assembled which is stable and free-standing, and included in this object is the provision of an exercise device for performing such exercises without the need of weights.

SUMMARY OF THE INVENTION

The present invention provides for a device to aid in performing proper squat exercises. The device is constructed from portable, light weight, cylindrical aluminum tubes, and includes foot guides, and knee guides, both of which may be moved to comply with the user's body size and degree of comfort.

The present invention provides for the foot guides to be mounted to a foot rod that is secured in place by a pair of support legs, and means provided for adjusting and securing the foot guides across a lateral range of from 3 to 20 inches.

Another aspect of the invention is providing a pair of knee guides which may slide laterally on a knee pole over a range from 3 to 20 inches.

An embodiment of the invention provides for means to vary the elevation of the knees from a point of 10 inches to a height of 21 inches.

Another inventive aspect of the invention is a hand grip having means to move towards or away from the user over a range of 2 to 6 inches. The vertical position of the hand grips may vary from a low of 44 inches to a high of 54 inches.

One embodiment of the invention comprises a squat bar for placement over the shoulders and behind the neck of the user. To create resistance a pair of rubber bands are employed whereby one end of each rubber band is attached to the squat bar and the other end to a support leg. By varying the resistance levels of the rubber bands, different difficulties may be introduced.

BRIEF DESCRIPTION OF THE DRAWINGS

Further characteristics and advantages of the present invention shall become more readily apparent from the detailed description of a preferred, but not exclusive embodiment of a training device for performing squat exercises, illustrated in the accompanying drawings, in which.

DETAILED DESCRIPTION OF THE INVENTION

The squat training device is designed to induce proper squatting technique to aid in the process of rehabilitation, personal training, overall strength and mass gains in the lower extremities. By guaranteeing perfect squat technique, the device creates the ultimate whole body workout. A squat exercise uses over 200 muscles when performed correctly, and the present invention prevents any possible muscle imbalances to arise. It also develops a strong balanced core, produces proper postural control and aids in injury prevention. The squat exercise is the most functional exercise and should be incorporated into all exercise prescriptions. Not only does the exercise strengthen the lower body, but it eliminates stress and shear forces acting upon the knee joints. Proper technique relieves this stress from both the ACL and MCL, and it helps prevent non-contact injuries to these structures. Proper squat technique will help you run faster and jump higher. The invention is designed to maintain proper alignment of the knees and the toes throughout every repetition. When training, people tend to have their knees knock inward, which puts stress on the MCL and predisposes them to MCL injuries. Also, when training, people tend to shift their weight forward and allowing their knees to move forward past their toes. This improper technique produces shear force on the ACL and will over develop the quadriceps muscles. The invention guarantees that proper knee alignment is maintained and none of these problems will occur.

Figure 1:
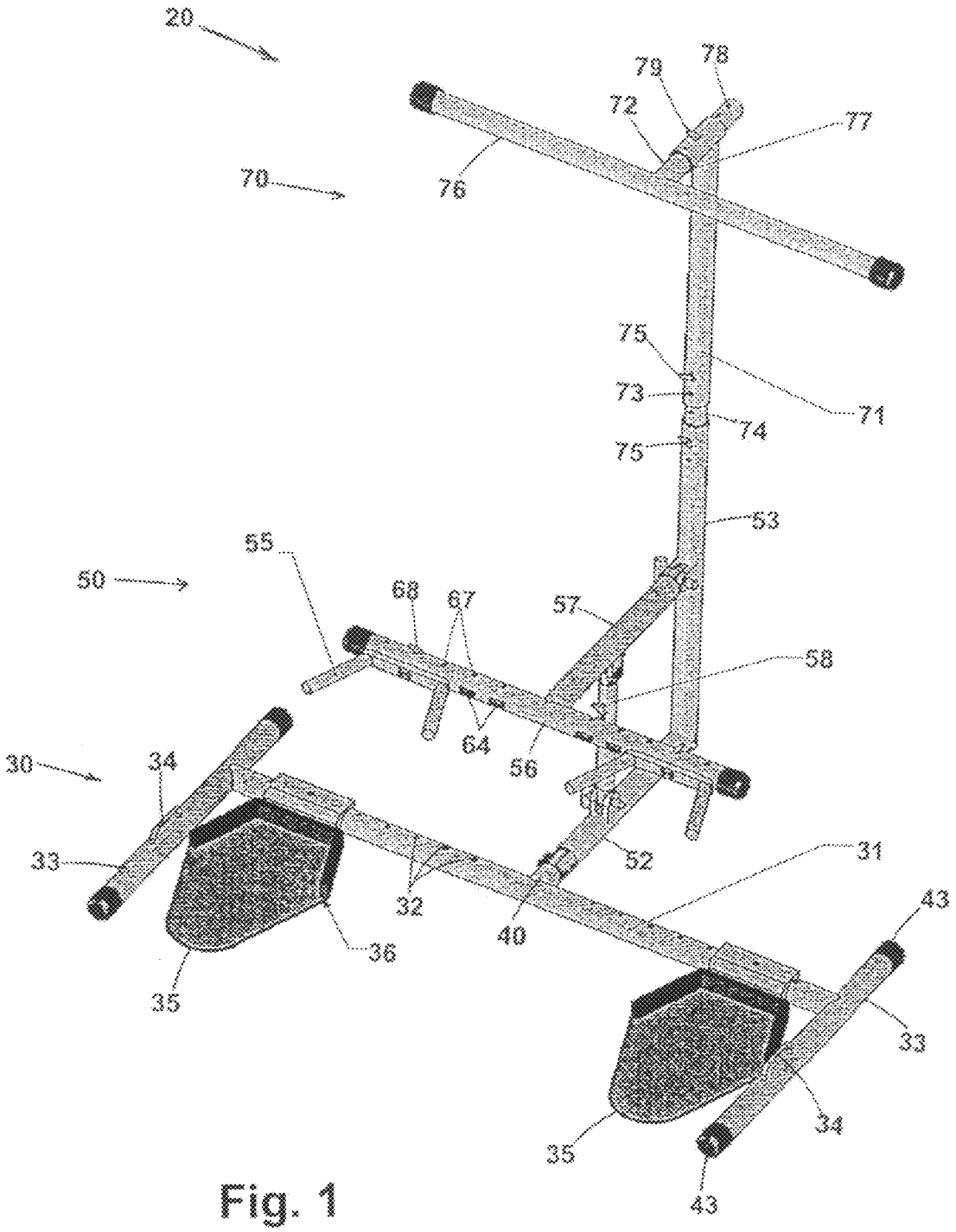
FIG. 1 is a pictorial view of a squat training device according to the present invention.

The exercise training device 20 of the present invention as seen in FIG. 1 will comprise three major portions: a foot portion 30: a knee portion 50 and a hand portion 70, with all three portions contributing to the overall stability and correct usage of the device 20.

The foot portion 30 consists of a foot rod 31 that is about 42 inches in length with a 21 inch support leg 33 welded to each end, such that there is 6 inches of each support leg extending in a forward direction and 15 inches extending in a rearward direction. The forward direction being as faced by the user when exercising. The foot rod 31 as well as the support legs 33 are made from 1.50 inch aluminum tube. The foot rod 31 has a plurality of holes 32 defined in the upper side of the rod 31. These holes are about 0.250 inches in diameter and preferably there are about 16 of them equally spaced (about 2 inches apart), with about 8 inches separating the 8 holes on either side of center. The ends of the support legs 33 have rubber caps 43 to prevent slipping.

Figure 2A:
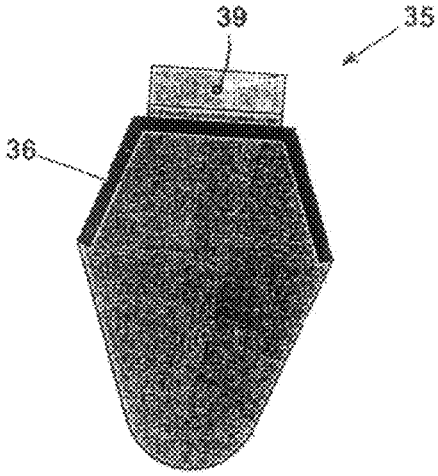
FIGS. 2*a* and 2*b* are a top plan view and a side view of a foot guide of FIG. 1.
Figure 2B:
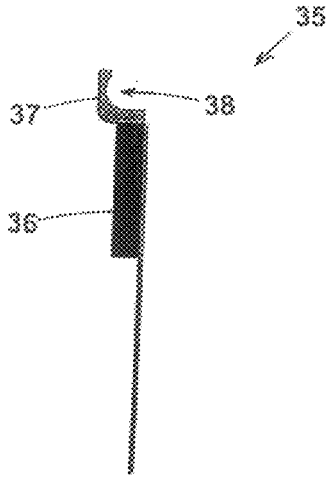

As previously stated, the crucial element of the device is the proper alignment of the user's body when conducting the squat exercise. To insure correct foot placement, a pair of foot guides 35 are provided and made from an aluminum diamond plate metal, although other materials may be equally effective. Each foot guide includes a bumper edge 36 in the front perimeter section to maintain the foot position of the user, as better seen in FIGS. 2*a* and 2*b*. The bumper edge 36 is preferably made from 0.50 inch by 1 inch rectangular aluminum stock. An L-shaped flange 37, having an inner side 38 curved to conform to the size and shape of the foot rod 31, is positioned over the rod 31 and can be slid along the rod while being adjusted to the user's personal preference and comfort. The total range of the foot guides 35 is from 3 inches to 20 inches. For locking down the foot guides 35 at positions along the rod 31, a threaded pin 39 is provided to fit into a slot of the flange. The head of the pin 39 has a slot for access by a screw driver type tool (not shown) which the user may use to release and move the foot guide and then tighten at a new position. Each support leg 33 has a three inch metal eyelet 34 attached to the top of the leg 33 for attachment of resisting bands which will be discussed later. At the forward center position of the foot rod 31 there is welded a connector piece 40 for attachment to the knee portion 50.

Figure 3:
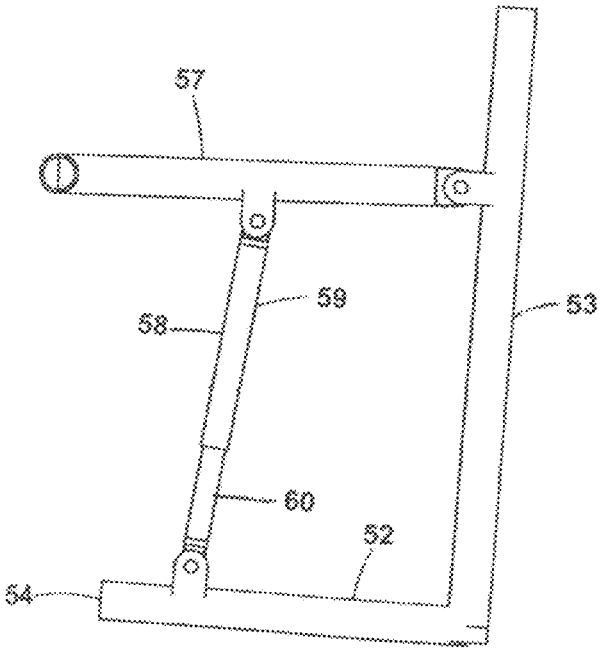
FIG. 3 is a side elevation view of the knee support structure.

The structural strength of the device is mainly provided by the knee portion 50 as best seen in FIGS. 1 and 3. An L-shaped support is formed from welding a 14 inch long aluminum tube to a 24 inch aluminum tube with both tubes having 1.50 inch diameters. The 14 inch tube forming a horizontal section 52 and the 24 inch tube forming a lower vertical section 53. A distal end 54 of the horizontal section 52 is connected to the connector piece 40 of the foot rod 31, whereupon the device 20 is in a stand free mode.

Figure 4A:
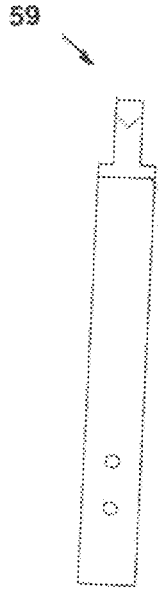
FIGS. 4*a* and 4*b* are elevation views of the upper inner rod and the lower outer rod respectively of the knee support structure.
Figure 4B:
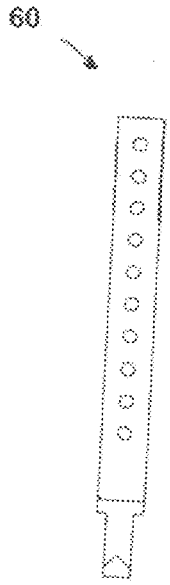

To insure correct alignment of the user's knees, a pair of knee guides 55 are provided which are attached to a cross-shaped framework consisting of a 26 inch knee pole 56 welded at its center to one end of a 14.5 inch cross pole 57. The other end of the cross pole 57 having a male clevis for attachment to a female clevis located on the lower vertical section 53, about 7 inches from the distal end of the lower vertical section 53. To provide an adjustable support for the knee pole 56, an adjustment rod 58 is provided. The adjustment rod 58, as best shown on FIGS. 3, 4*a* and 4*b*, consists of an upper inner pipe 59 (1.25 inch aluminum tube) of about 8 inch length with a male clevis welded to the top section for connecting to a female clevis located on the bottom side of the cross pole 57 at a distance of about 6.65 inches from the clevis located on the lower vertical section 53, and a lower outer pipe 60 (1.50 inch aluminum tube) of about 7.5 inch in length with a male clevis welded at its lower end for fastening to a female clevis located on the upper side of the horizontal section 52, with the connection about 3.375 inches from the distal end 54 of the horizontal section. This adjustment feature allows for a vertical movement range of the knee guides 55 to be about 10 inches to 21 inches from the ground level.

Figure 5:
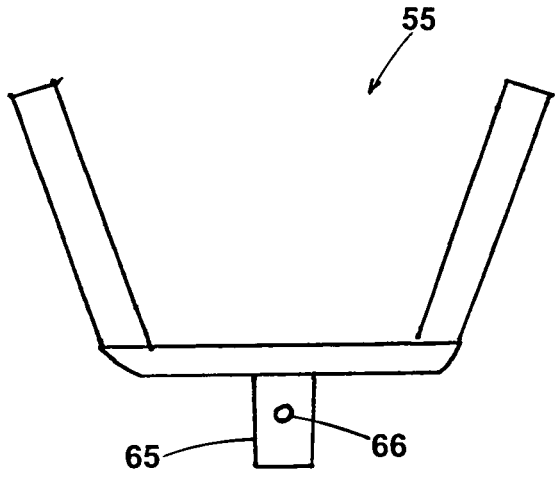
FIG. 5 is a top plan view of a knee guide.

The knee guides 55 may be positioned at a variety of locations along the knee pole 56. As best shown in FIG. 5, each knee guide 55 is equipped with a 1 inch wide edge 65 that is positioned into one of 10 slots 64 defined along the rear side of the knee pole 56, with each slot 64 about 1 inch wide and about 1 inch apart. A round pin hole 66 in each edge 65 allows the edge to be aligned with one of the ten round apertures 67 defined in the top side of the knee pole. The user, upon selection of the proper position of the knee guides, can lock in the guides by insertion of a pin 68 passing through the aligned pin hole 66 and aperture 67. The knee guides 55 have a lateral range of about 3 to 20 inches.

For further balance the device 20 is complete with a hand portion 70, which is formed from the sliding connection of two pieces. The first piece is a result of welding two 1.50 inch diameter aluminum tubes together. An upper vertical section 71, approximately 20 inches long is welded at a top end perpendicularly to a 4 inch open-ended tube 72. The upper vertical section 71 has a plurality of alignment holes 73 defined in the lower part of the section. The upper vertical section 71 connects to the lower vertical section 53 by sliding an interlinking short tube 74, with a 1.25 inch diameter, between the two vertical section 71, 53 to create a friction fit and connection the two sections is performed by aligning holes and securing with pins 75. The vertical arm extension provided by sections 53 and 71, allows for a vertical range of 44 to 54 inches.

The second piece of the hand portion 70 is made by welding together at perpendicular angles 1.25 inch diameter aluminum tubes, one being a 32 inch hand grip 76 and the other a 9 inch long sliding extension 77 welded to the center of the hand grip 76. The sliding extension 77 has a plurality of 0.250 inch holes 78, preferably six, and by moving the sliding extension 77 through the open ended tube 72, the user may select a comfortable position and lock securely by aligning a hole 78 in the sliding extension 77 with a similar sized hole in the open ended tube 72 and secure with a pin 79 through the aligned holes. The range of movement by the hand grip 76 is about 2 to 6 inches.

Figure 6:
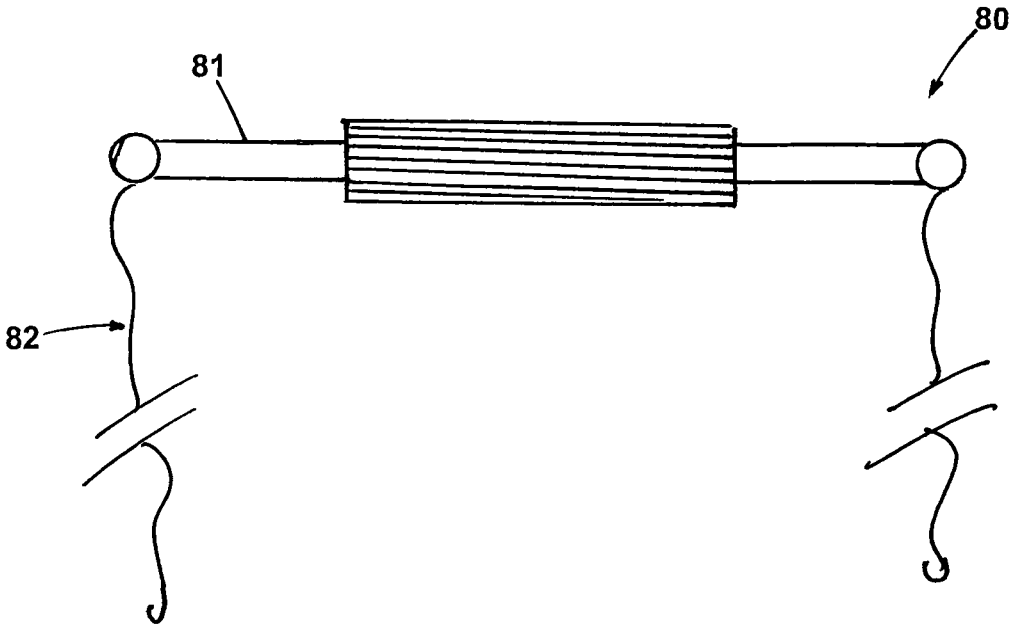
FIG. 6 is a pictorial view of a squat bar with resistance bands attached.

An optional squat bar attachment 80 may be included with the device 20. As shown in FIG. 6, the attachment includes a squat pole 81 which is designed to be placed about the shoulders of the user and be made from a lightweight, plastic pole. Preferably, the center of the pole will be padded with foam-like material for comfort around the user's neck and shoulders, and the pole should be able to bend to the contour of the user's shoulders. A pair of resistance bands 82, each having one end connected to an end of the squat pole 81 and the opposing end connected to one of the eyelets 34 of a support leg 33. The training device 20 will offer a plurality of resistance bands 82, each having a varying level of resistance to mimic varying weights. The user can simply interchange bands to achieve a different training difficulty. A harness (not shown) could be substituted for the squat pole 81 without affecting the integrity of the device.

The individual will first set up the foot braces evenly and at the proper width for their use. They will then place the knee braces in the adjacent holes in the top horizontal pole. This will end up with the knee and foot braces being directly aligned with each other. If the individual is using resistance, they will place the squat pole onto their shoulders. With their hands on the handles, they will slow descend into the squat form by keeping the chest upright and the core engaged, bend at both the knees and hips without allowing the knees to touch the front or sides of the braces and when reached the proper depth of the squat, in a controlled manner stand straight up. This squat device 20 can also be used for single leg squats, split squats and lunges, maintaining the integrity of the knee alignment. When the resistance of the bands pulls upward on the device the body weight of the individual will be actually holding the entire device down. The reason for this is to eliminate the need for a very heavy base to counter the upward resistance from the bands. Attached to the sides of the braces there will be eyelets connected to them in order to attach the resistance bands to them for their use during the exercise.

It is essential that the device be capable of easy disassembling and be quickly compacted for transporting or storage. Thus all the main portions foot 30, knee 50 and hand 70, are all disconnected by merely pulling pins out of holes.

Further, it is readily apparent from the foregoing that a new and useful embodiment of the present invention has been described and illustrated which fulfills all of the stated objects in an unexpected fashion. It is to be understood that various different modifications are possible and are contemplated within the true spirit and scope of the appended claims. There is no intention, therefore, of limitations to the exact abstract or disclosure herein presented.

What is claimed is:

1. A squat exercise training device, comprising:

a foot portion comprising a foot rod stabilized at each end by a pair of welded support legs; and a pair of movable foot guides mounted to the foot rod and configured for allowing a user to slide and secure the position of the foot guides, each foot guide having an L-shaped flange with an inner side conforming to a size and shape of the foot rod; and the flange having a slot for aligning with one of a plurality of holes in the foot rod, wherein the foot guide may be secured to the foot rod by tightening or loosening a threaded pin using a screw driver like tool;

a knee portion comprising a cross-shaped framework including a knee pole;

a pair of knee guides configured to slide and be positioned at varying positions along the knee pole; and a supporting structure connected to the foot portion and configured to vary the elevation of the knee guides; and a hand portion comprising a hand grip including a sliding extension slid through an open-ended tube, the hand grip is configured to move vertically or laterally, and be secured with a locking pin;

the hand portion including an upper vertical section for connecting the knee portion, and wherein the device insures that the user's body is placed into the correct alignment when performing squat exercises.

2. The training device of claim 1, wherein the supporting structure comprises:

an L-shaped support formed from welding one end of a horizontal section to the foot rod, and the other end to a lower vertical section;

a cross-shaped framework having one end of a cross pole welded to the center of the knee pole and the other end of the cross pole connected by a first clevis mechanism to the lower vertical section;

an adjustable means comprising an adjustment rod having two pipes, an upper inner pipe having a distal end connected with a second clevis mechanism to the cross pole and an opposite end telescoping with a lower outer pipe which has a distal end connected to the horizontal section by a third clevis mechanism, wherein the knee guides may be altered by the coordinated movement of the three clevis mechanisms.

3. The training device of claim 2, wherein a vertical adjustment range for the knee guides is from 10 to 21 inches from the floor.

4. The training device of claim 1, wherein moving the hand grip vertically comprises movably connecting the upper vertical section to a lower vertical section by placing a smaller diameter tube between them and cascading the tubes about the smaller tube to raise or lower the height of the hand grip.

5. The training device of claim 4, wherein a height variation of the hand grip ranges from 44 to 54 inches.

6. The training device of claim 1, wherein moving the hand grip laterally comprises moving a sliding extension welded perpendicularly to the center of the hand grip and sliding it with a frictional fit through an open-ended tube that is welded to the top end of the upper vertical section and the hand grip secured by pinning into holes made by aligning the two pieces.

7. The training device of claim 6, wherein a range of lateral movement of the hand grip is about 2 to 6 inches.

8. The training device of claim 1, wherein a range of movement of the foot guides is from 3 to 20 inches.

9. The training device of claim 1, wherein each knee guide comprises:

having a one inch wide edge which can be positioned into one of ten slots defined in the knee pole; and each edge having a round pin hole for aligning with one of ten apertures in the top side of the knee pole, wherein the knee guides may be secured by insertion of a pin through aligned pin hole and aperture.

10. The training device of claim 1, wherein a range of lateral movement of the knee guides is from 3 to 20 inches.

11. The training device of claim 1, wherein the hand grip is a tubular piece of aluminum construction with either 1.250 or 1.50 inch diameters.

12. The training device of claim 1, wherein the device further comprises:

a pair of eyelets attached to the upper side of each leg support;

a squat pole; and a pair of resistance bands, wherein one end of each resistance band is attached to the squat pole and the opposing end attached to the eyelet of a support leg.

13. A squat exercise training device, comprising:

a foot portion comprising a foot rod stabilized at each end by a pair of welded support legs;

a pair of movable foot guides mounted to the foot rod, and configured for allowing the user to adjust and secure the position on the foot guides, each foot guide having an L-shaped flanged with an inner side conforming to a size and shape of the foot rod; and wherein the foot guide is secured to the foot rod by aligning holes in both pieces and tightening with a threaded pin such that a range of movement of the foot guides is from 3 to 20 inches;

a knee portion comprising a cross-shaped framework having a knee pole;

a pair of slidable knee guides configured to slide and be positioned at varying positions along the knee pole; and a supporting structure connected to the foot portion and configured to vary the elevation of the knee guides; and a hand portion comprising a hand grip having a sliding extension slid through an open-ended tube, is configured to move in relationship with a user, and be secured with a locking pin, the hand portion including an upper vertical section for connecting to the knee portion; and a squat bar attachment comprising a squat pole and a pair of resistance bands, wherein one end of each band is attached to an end of the squat pole and an opposing end of the band is attached to an eyelet on a support leg, wherein the user may perform the squat exercise while using the resistance bands to simulate the resistance that weights would provide.

14. The training device of claim 13, wherein the supporting structure comprises:

an L-shaped support formed from a horizontal section, and a lower vertical section;

a cross-shaped framework having one end of a cross pole welded to the center of the knee pole and the other end of the cross pole connected by a first clevis mechanism to the lower vertical section;

an adjustable means comprising an adjustment rod having two pipes, an upper inner pipe having a distal end connected with a second clevis mechanism to the cross pole and an opposite end telescoping with a lower outer pipe which has a distal end connected to a horizontal section by a third clevis mechanism, wherein the knee guides may be altered by the coordinated movement of the three clevis mechanisms such that a vertical adjustment range for the knee guides is from 10 to 21 inches from the ground floor.

15. The training device of claim 14, wherein the hand grip is configured to move vertically, moving the hand grip vertically comprises movably connecting the upper vertical section to the lower vertical section by placing a smaller diameter tube between them and cascading the tubes about the smaller tube to raise or lower the height of the hand grip, such that the hand grip may vary in vertical height from 44 to 54 inches from the ground floor.

16. The training device of claim 13, wherein each knee guide has a one inch wide edge which can be inserted into one of a plurality of one inch slots defined in the knee pole, each edge having a round pin hole which upon being aligned with one of a plurality of apertures in the top side of the knee pole, may be secured by insertion of a pin through the aligned pin hole and aperture, wherein a range of lateral movement of the knee guides is from 3 to 20 inches.

17. The training device of claim 13, wherein the hand grip is configured to move laterally, moving the hand grip laterally comprises moving a sliding extension welded perpendicularly to the center of the hand grip and sliding it with a frictional fit than an open-ended tube that is welded to the top end of the upper vertical section and the hand grip secured by pinning into holes made by aligning the two pieces, such that the lateral movement is from 2 to 6 inches.

18. The training device of claim 13, wherein the hand grip is a tubular piece of aluminum construction having either 1.250 inch or 1.50 inch diameters.

* * * * *